US007128611B2

(12) United States Patent
Tanaka

(10) Patent No.: US 7,128,611 B2
(45) Date of Patent: Oct. 31, 2006

(54) ELECTRIC CONNECTOR INCLUDING SIGNAL CONTACT PAIRS AND GROUND CONTACTS PROVIDED IN ROWS AT A FIRST END, IN WHICH THE GROUND CONTACTS ARE PROVIDED BETWEEN SIGNAL CONTACT PAIRS FROM THE RESPECTIVE ROWS AT A SECOND END

(75) Inventor: Yukitaka Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/252,357

(22) Filed: Oct. 17, 2005

(65) Prior Publication Data

US 2006/0084320 A1 Apr. 20, 2006

(30) Foreign Application Priority Data

Oct. 19, 2004 (JP) ..... 2004-304354

(51) Int. Cl.
*H01R 31/06* (2006.01)

(52) U.S. Cl. ..... 439/628; 439/108

(58) Field of Classification Search ..... 439/660, 439/108, 608

See application file for complete search history.

(56) References Cited

U.S. PATENT DOCUMENTS 5,224,867 A * 7/1993 Ohtsuki et al. ..... 439/108
5,346,404 A * 9/1994 Shimada ..... 439/108
5,944,541 A * 8/1999 Payne ..... 439/108
5,971,809 A * 10/1999 Ho ..... 439/660
6,350,134 B1 * 2/2002 Fogg et al. ..... 439/79
6,375,508 B1 * 4/2002 Pickles et al. ..... 439/608
6,540,559 B1 * 4/2003 Kemmick et al. ..... 439/608
6,935,870 B1 * 8/2005 Kato et al. ..... 439/108

FOREIGN PATENT DOCUMENTS

JP 2000-182733 A 6/2000
JP 2002-334738 A 11/2002

* cited by examiner

*Primary Examiner*—Hae Moon Hyeon
(74) *Attorney, Agent, or Firm*—Frishauf, Holtz, Goodman & Chick, P.C.

(57) ABSTRACT

In an electric connector having a first end and a second end opposite to the first end, an insulator supports conductive contacts including signal contact pairs and ground contacts. Each of the signal contact pairs includes a pair of the conductive contacts. At the first end, the signal contact pairs and the ground contacts are arranged in a first and a second row, respectively, which are parallel to each other and extend in a first direction. At the second end, the signal contact pairs and the ground contacts are arranged in a single row so that each of the ground contacts are interposed between each of the signal contact pairs on the first row at the first end and each of the signal contact pairs on the second row at the first end.

10 Claims, 8 Drawing Sheets

ELECTRIC CONNECTOR INCLUDING SIGNAL CONTACT PAIRS AND GROUND CONTACTS PROVIDED IN ROWS AT A FIRST END, IN WHICH THE GROUND CONTACTS ARE PROVIDED BETWEEN SIGNAL CONTACT PAIRS FROM THE RESPECTIVE ROWS AT A SECOND END

This invention claims priority to prior Japanese patent application JP 2004-304354, the disclosure of which is incorporated herein by reference.

BACKGROUND OF THE INVENTION

The present invention relates to electric connectors for connecting connection objects.

There is an electric connector that transmits a single data signal as a differential signal using two signal lines, or in other words, an electric connector used for connecting signal circuits of a differential-signal-transmission type. Two types of transmission for digital signals are known, which are an unbalanced type (i.e. a single-ended type) and a balanced type (i.e. a differential type).

In unbalanced-type (single-ended type) signal transmission, a digital signal is determined to be high or low based on a potential difference between a ground line and a single signal line. On the other hand, in balanced-type (differential type) signal transmission, a digital signal is determined to be high or low based on a potential difference between two signal lines. In the latter case, the magnitude of the signal voltage between the two signal lines is the same, whereas the phase between the two signal lines is different by 180°. Furthermore, in transition minimized differential signaling, or TMDS, data transmission is achieved by using two signal lines and a single ground line.

In the balanced-type (differential-type) signal transmission, the impedance matching between positive-signal contacts and ground contacts and between negative-signal contacts and ground contacts must be evenly attained.

In the balanced-type (differential-type) signal transmission, since a noise generated in the two signal lines is cancelled at the input stage of a receiver, the signal transmission can be achieved with higher reliability in comparison to the unbalanced-type (single-ended type) signal transmission.

A known connector for differential signal transmission includes contacts and an insulator supporting the contacts. When using such a connector for transmitting a differential signal, each pair of signal contacts S is connected to a corresponding pair of signal lines, and each ground contact G is connected to a corresponding ground line.

The contacts include a plurality of signal contacts S, a plurality of ground contacts G, and a plurality of general (low-speed) contacts D. The signal contacts S, the ground contacts G, and the general contacts D are arranged in the following order: S, S, G, S, S, G, S, S, D, D, D. An example of such a connector is disclosed in Japanese Unexamined Patent Application Publication (JP-A) No. 2002-334738.

Furthermore, an intermediate connector is also known, which includes a connection member and a housing that houses the connection member. The housing has a jack portion and a plug portion. The connection member has a first contact segment, a second contact segment, and a coupling segment. The first contact segment is substantially U-shaped so that the first contact segment is engageable to a connection terminal of a modular plug. The second contact segment is connectable to an input-output connector. An example of such an intermediate connector is disclosed in Japanese Unexamined Patent Application Publication (JP-A) No. 2000-182733.

In the connector according to Japanese Unexamined Patent Application Publication (JP-A) No. 2002-334748, however, the contacts are combined simply by arranging each pair of signal contacts S adjacent to each other and disposing each ground contact G adjacent to the pair.

For this reason, in a case where the signal contacts S of each pair are switched with each other, the electrical relationship between the pair of signal contacts S and the ground contact G cannot be maintained. Accordingly, when a differential signal is to be transmitted, a high performance cannot be maintained with respect to high-frequency characteristics.

On the other hand, the connection member of the intermediate connector disclosed in Japanese Unexamined Patent Application Publication (JP-A) No. 2000-182733 is not used in view of high-frequency characteristics.

SUMMARY OF THE INVENTION

It is therefore an object of the present invention to provide an electric connector in which the electrical relationship between each pair of signal contacts and each ground contact can be maintained even when the two signal contacts of the pair are switched with each other.

It is another object of the present invention to provide an electric connector that can readily maintain the impedance matching, and can be improved in performance with respect to high-frequency characteristics.

Other objects of the present invention will become clear as the description proceeds.

According to an aspect of the present invention, there is provide an electric connector having a first end and a second end opposite to the first end, the electric connector comprising a plurality of conductive contacts and an insulator supporting the conductive contacts, the conductive contacts comprising a plurality of signal contact pairs each comprising a pair of the conductive contacts and a plurality of ground contacts. At the first end, the signal contact pairs and the ground contacts being arranged in a first and a second row, respectively, which are parallel to each other and extend in a first direction. At the second end, the signal contact pairs and the ground contacts are arranged in a single row so that each of the ground contacts are interposed between each of the signal contact pairs on the first row at the first end and each of the signal contact pairs on the second row at the first end.

DESCRIPTION OF THE PREFERRED EMBODIMENTS

Figure 1:
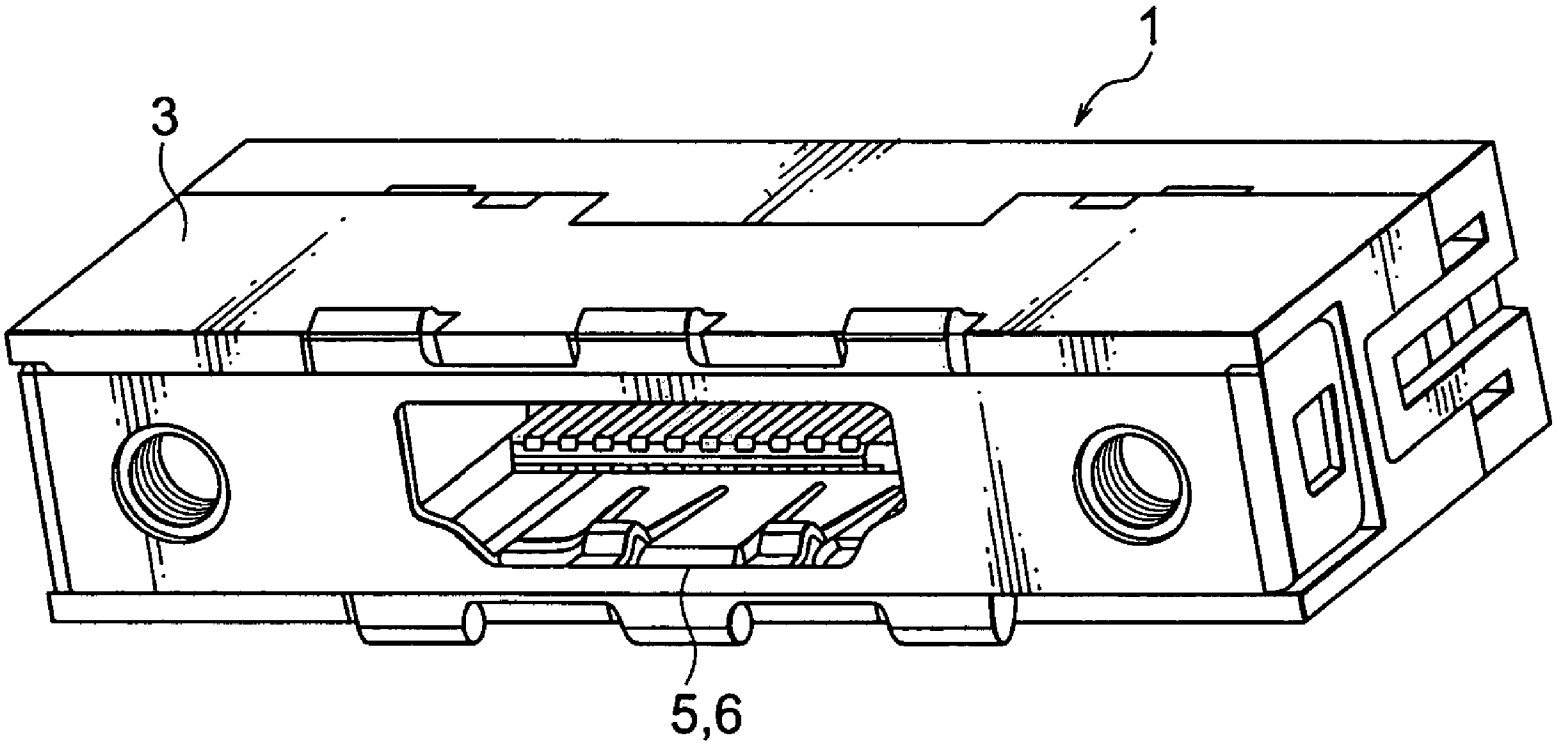
FIG. 1 is a perspective view of a connector according to a first embodiment of the present invention, in which the front surface of the connector is viewed at an angle.
Figure 2:
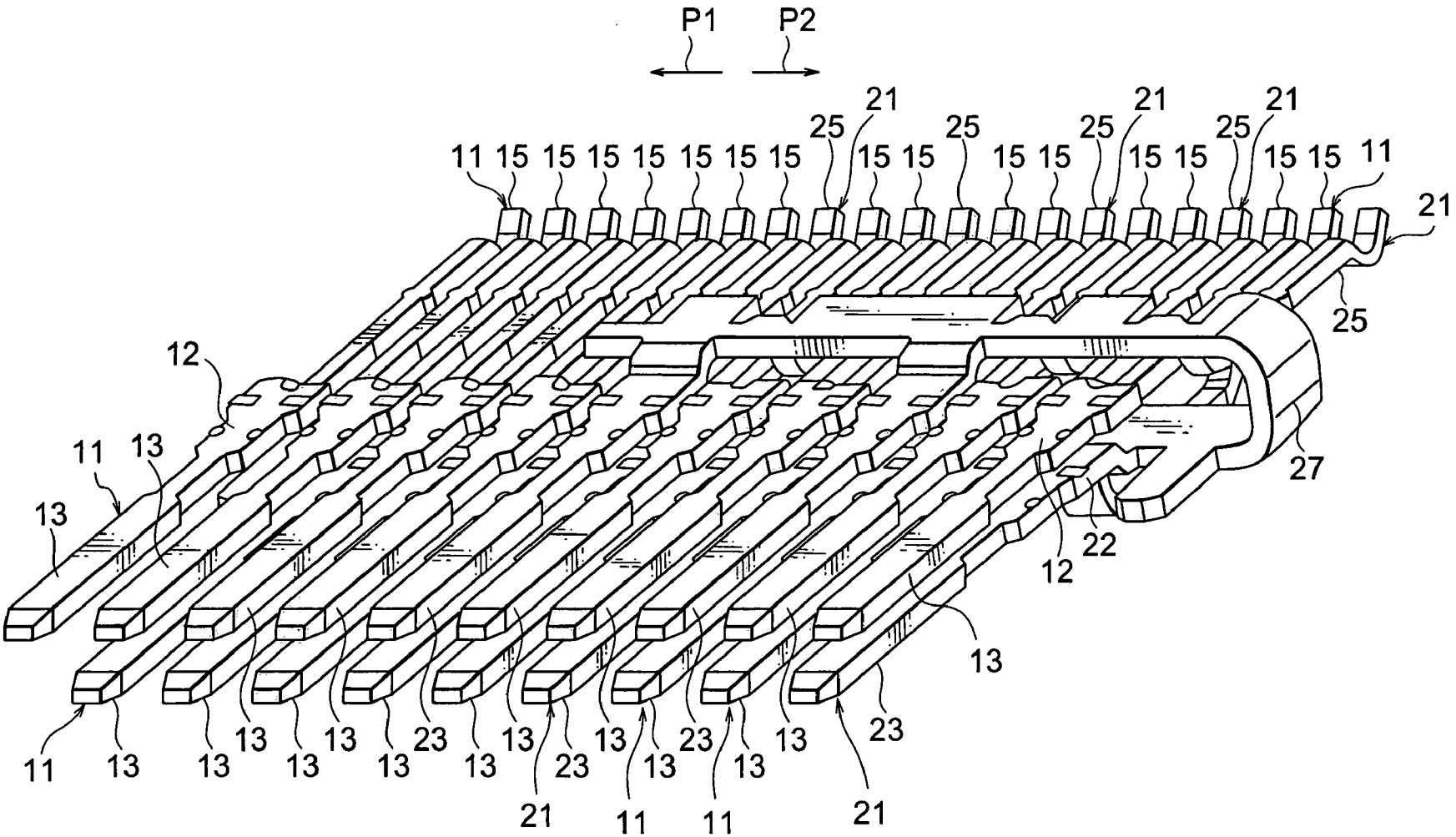
FIG. 2 is a perspective view of contacts included in the connector shown in FIG. 1.

Referring to FIGS. 1 and 2, a connector 1 has a first end and a second end opposite to the first end. The connector 1 includes an insulator 3, a plurality of electrically conductive signal contacts 11, and a plurality of electrically conductive ground contacts 21.

Figure 3:
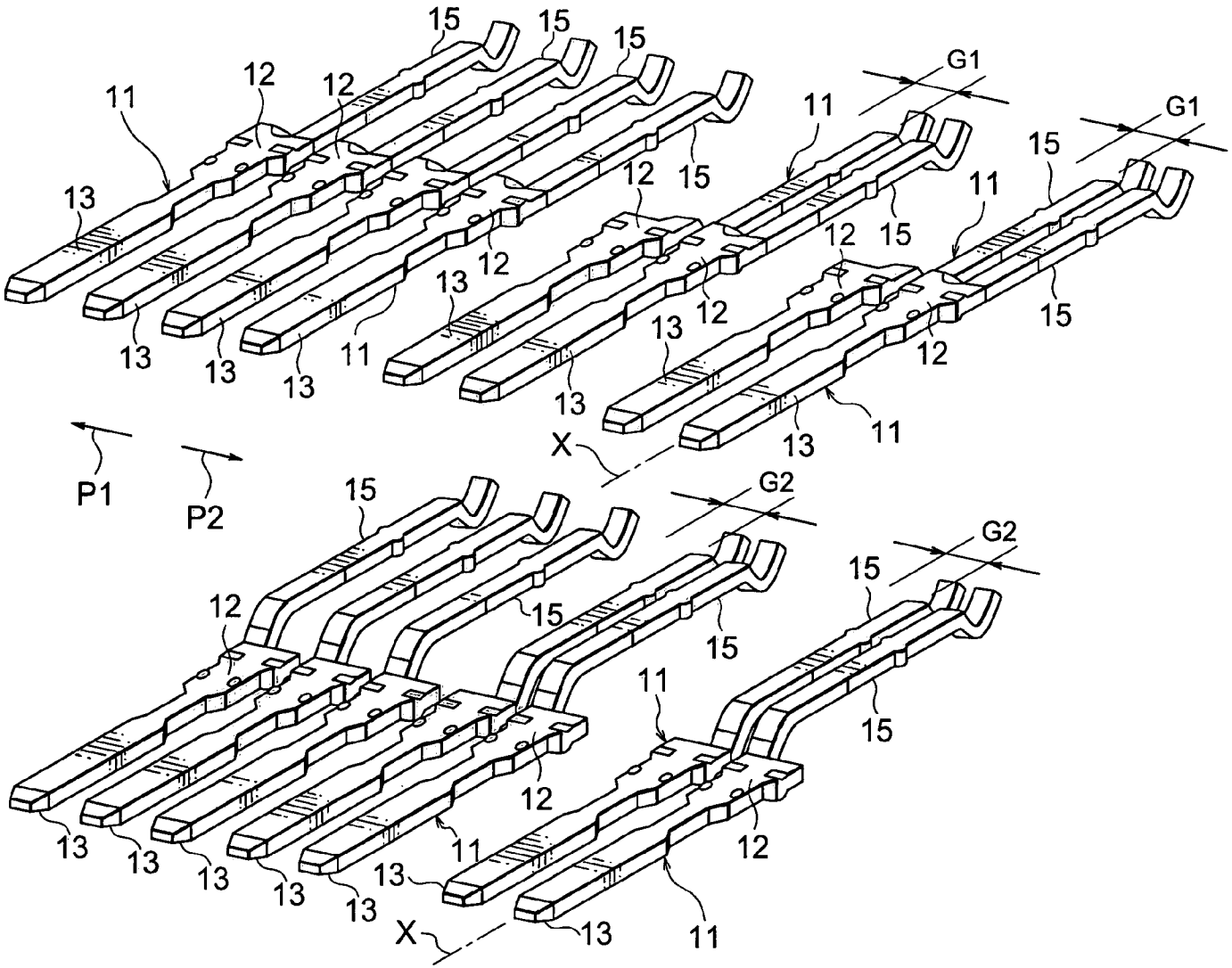
FIG. 3 is a perspective view of signal contacts shown in FIG. 2.

Referring to FIG. 3, each of the signal contacts 11 and ground contacts 21 extends parallel to an axis line X. Moreover, referring to FIGS. 2 and 3, the signal contacts 11 and the ground contacts 21 are supported by the insulator 3, such that the signal contacts 11 and the ground contacts 21 are arranged at a predetermined pitch in pitch directions (a first direction) P1 and P2 perpendicular to the axis line X and are combined in an imaginary plane that includes the axis line X.

In the connector 1 according to the first embodiment, the plurality of signal contacts 11 includes two types, namely, a type for general (low-speed) signal transmission and a type for high-speed signal transmission. Specifically, referring to FIG. 2, four of the signal contacts 11 disposed in the upper level and counted from the leftmost signal contact 11 with respect to the pitch direction P1 towards the pitch direction P2 are for general (low-speed) signal transmission. On the other hand, in FIG. 2, three of the signal contacts 11 disposed in the lower level and counted from the leftmost signal contact 11 with respect to the pitch direction P1 towards the pitch direction P2 are for general (low-speed) signal transmission.

Referring to FIGS. 2 and 3, each signal contact 11 includes a support segment 12, a first signal connection segment (first connection segment) 13 extending from a first end of the support segment 12, and a second signal connection segment (second connection segment) 15 extending from a second end of the support segment 12.

The first signal connection segments 13 are divided into an upper and a lower arrays, which are spaced in a second direction perpendicular to the axis line X and the first direction. The upper array is arranged in the upper level or a first row at intervals in the pitch directions P1 and P2. The lower array is arranged in the lower level or a second row at intervals in the pitch directions P1 and P2.

Specifically, the first signal connection segments 13 are arranged in two arrays at the first end of the connector 1 in a manner such that the upper array and the lower array face each other in a direction perpendicular to the imaginary plane that includes the axis line X. On the other hand, the second signal connection segments 15 are arranged in a single array at the second end of the connector 1 to have intervals in the pitch directions P1 and P2.

Figure 4:
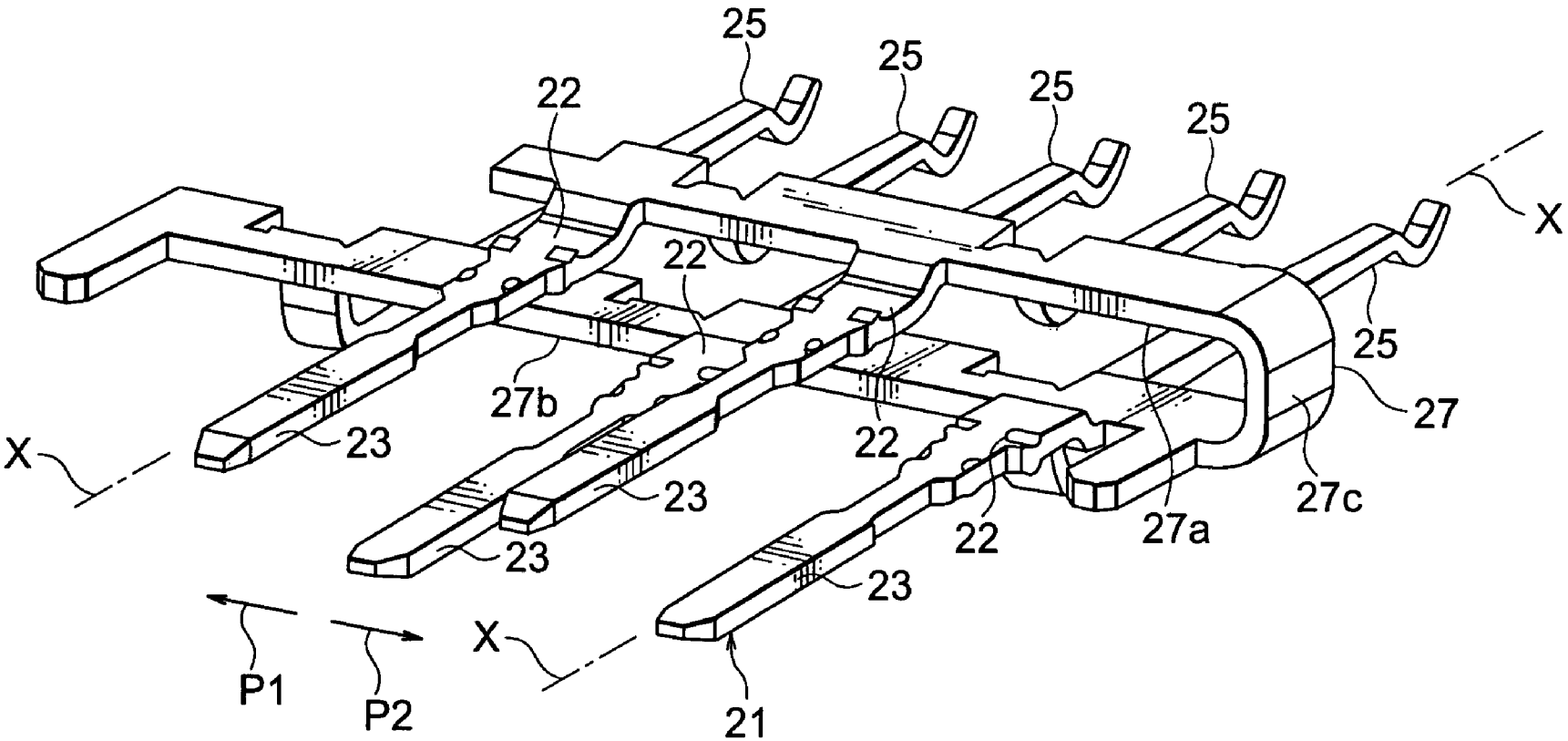
FIG. 4 is a perspective view of ground contacts shown in FIG. 2.

Referring to FIGS. 2 and 4, the ground contacts 21 include ground support segments 22, first ground connection segments (first connection segments) 23 extending as one of contact terminals from first ends of the ground support segments 22, an intermediate segment 27 connecting the ground support segments 22, and second ground connection segments (second connection segments) 25 extending as another of contact terminals from the intermediate segment 27 and disposed adjacent to second ends of the ground support segments 22. It is to be noted that each of the first connection segments 23 and each of the second connection segments 25 are placed different to each other in the pitch directions P1 and P2.

The first ground connection segments 23 extending from the ground support segments 22 are divided into two arrays, which are an upper array arranged in the upper level at an interval in the pitch directions P1 and P2 and a lower array arranged in the lower level at an interval in the pitch directions P1 and P2.

Two of the first ground connection segments 23 are disposed in the upper array, and another two of the first ground connection segments 23 are disposed in the lower array. In other words, the first ground connection segments 23 are arranged in two arrays in a manner such that the upper array and the lower array face each other in a direction perpendicular to the imaginary plane that includes the axis line X. On the other hand, the second ground connection segments 25 are arranged in a single array at an interval in the pitch directions P1 and P2.

The intermediate segment 27 includes an upper plate 27*a* extending longitudinally in the pitch directions P1 and P2, a lower plate 27*b* facing the upper plate 27*a*, and a coupling plate 27*c* for coupling the ends of the upper plate 27*a* and the lower plate 27*b* closer to the pitch direction P2.

The intermediate segment 27 substantially has a horizontal U-shape as viewed from the front in FIGS. 2 and 4. Each of the ground contacts 21 is integrally connected to the upper plate 27*a* or the lower plate 27*b* of the intermediate segment 27 via the ground support segment 22 thereof.

The first ground connection segments 23 are arranged alternately in the upper array and the lower array in the pitch directions P1 and P2. On the other hand, the second ground connection segments 25 are arranged in a manner such that the axis line X of each second ground connection segment 25 is not aligned with the axis line X of the corresponding first ground connection segment 23 with respect to the pitch direction P1 or P2.

Figure 5:
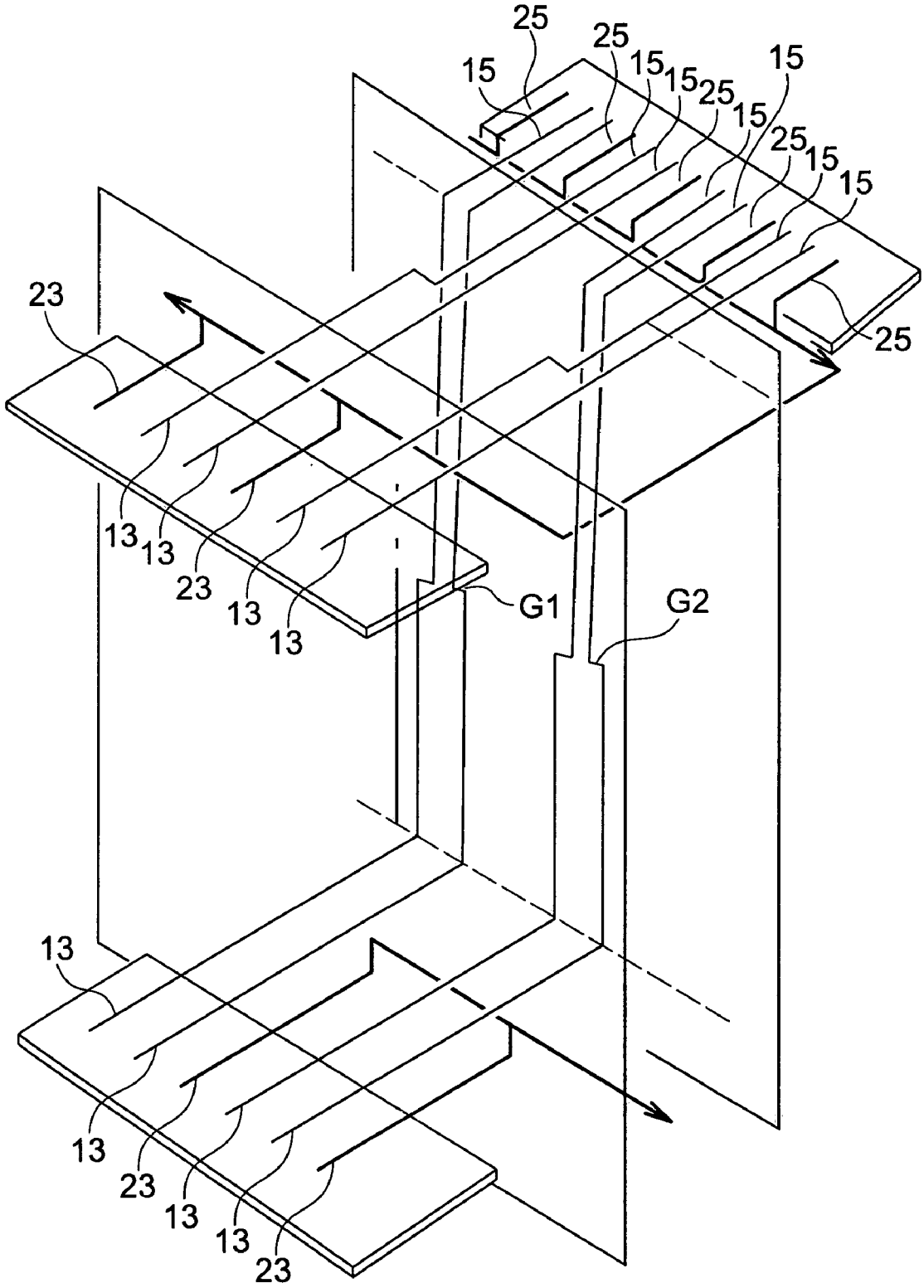
FIG. 5 is a schematic diagram of signal lines and ground lines of the connector shown in FIG. 2.

FIG. 5 illustrates signal lines of the signal contacts 11 and ground lines of the ground contacts 21. Specifically, FIG. 5 is a schematic diagram of the signal lines and the ground lines in a state where the signal contacts 11 for general signal transmission illustrated in FIGS. 2 and 3 are not shown.

Referring to FIGS. 1 to 5, each ground contact 21 is disposed between a corresponding pair of adjacent signal contacts 11. In other words, each of the ground contacts 21 is interposed between adjacent ones of the signal contact pairs.

The first ground connection segment 23 and the ground support segment 22 of each ground contact 21 are disposed between a corresponding pair of first signal connection segments 13 arranged in the upper array or the lower array. On the other hand, the second ground connection segment 25 of each ground contact 21 is disposed between a corresponding pair of second signal connection segments 15 arranged in a single array.

The signal contacts 11 and the ground contacts 21 are divided into four groups so that impedance matching can be maintained. Referring to FIG. 2, a first group of the signal contacts 11 and the ground contacts 21 is defined by a combination of the rightmost pair of first signal connection segments 13 of the signal contacts 11 in the upper array and the rightmost first ground connection segment 23 of the ground contact 21 in the lower array.

Furthermore, a second group of the signal contacts 11 and the ground contacts 21 is defined by a combination of the first ground connection segment 23 of the ground contact 21 positioned third from the right in the upper array and a pair of first signal connection segments 13 of the signal contacts 11 positioned second and third from the right in the lower array.

Furthermore, a third group of the signal contacts 11 and the ground contacts 21 is defined by a combination having an arrangement similar to that of the first group with respect to the pitch direction P1. Moreover, a fourth group is defined by a combination having an arrangement similar to that of the second group with respect to the pitch direction P1.

From the right of the drawings in FIGS. 2 and 3, the first signal connection segments 13 and the first ground connection segments 23 in the upper array are arranged in the pitch directions P1 and P2 in the following order: a pair of first signal connection segments 13 of the signal contacts 11, one first ground connection segment 23, a pair of first signal connection segments 13, and one first ground connection segment 23.

On the other hand, from the right of the drawings, the first signal connection segments 13 and the first ground connection segments 23 in the lower array are arranged in the pitch directions P1 and P2 in the following order: one first ground connection segment 23, a pair of first signal connection segments 13 of the signal contacts 11, one first ground connection segment 23, and so on.

From the right of the drawing in FIG. 2, the second signal connection segments 15 and the second ground connection segments 25 are arranged in the pitch directions P1 and P2 in the following order: a second ground connection segment 25 of one ground contact 21, a pair of second signal connection segments 15 of signal contacts 11 disposed in the upper level, one second ground connection segment 25, and so on. In other words, the signal contact pairs on the first row at the first end of the connector 1 and the signal contact pairs on the second row at the first end of the connector 1 are alternately arranged along the single row at the second end of the connector 1.

Consequently, as shown in FIG. 2, the arrangement in the combination of the pairs of second signal connection segments 15 and the second ground connection segments 25 in a single array corresponds to the arrangement in the combination of the first to fourth groups described above. In other words, each pair of second signal connection segments 15 is disposed between the second ground connection segments 25 of two ground contacts 21 at a regular pitch.

In the arrangement in the combination of the signal contacts 11 and the ground contacts 21, the plurality of first signal connection segments 13 and the plurality of first ground connection segments 23 are arranged at the same pitch in the pitch directions P1 and P2. Moreover, in such arrangement in the combination of the signal contacts 11 and the ground contacts 21, the second signal connection segments 15 and the second ground connection segments 25 are arranged at the same pitch in the pitch directions P1 and P2.

Referring to FIG. 3, in each pair of the second signal connection segments 15 connected to the corresponding first signal connection segments 13 of the upper array, the second signal connection segment 15 positioned closer to the pitch direction P1 is offset by a distance G1 towards the second signal connection segment 15 positioned closer to the pitch direction P2. Likewise, in each pair of the second signal connection segments 15 connected to the corresponding first signal connection segments 13 of the lower array, the second signal connection segment 15 positioned closer to the pitch direction P2 is offset by a distance G2 towards the second signal connection segment 15 positioned closer to the pitch direction P1.

Accordingly, in the signal contacts 11, one of the second signal connection segments 15 in each pair is offset in the pitch direction P2 so that the second signal connection segments 15 and the second ground connection segments 25 can be arranged at the same pitch in the pitch directions P1 and P2.

The pitch for the first signal connection segments 13 and the first ground connection segments 23 in the pitch directions P1 and P2 does not necessarily have to be equal to the pitch for the second signal connection segments 15 and the second ground connection segments 25 in the pitch directions P1 and P2.

Figure 6:
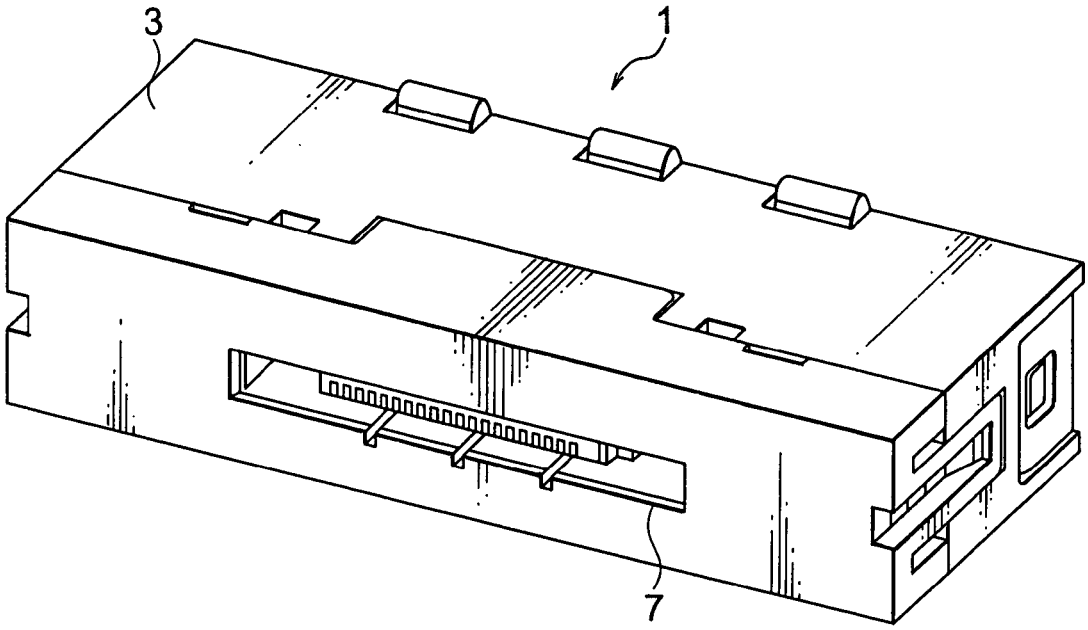
FIG. 6 is a perspective view illustrating the back surface of the connector shown in FIG. 1.
Figure 7:
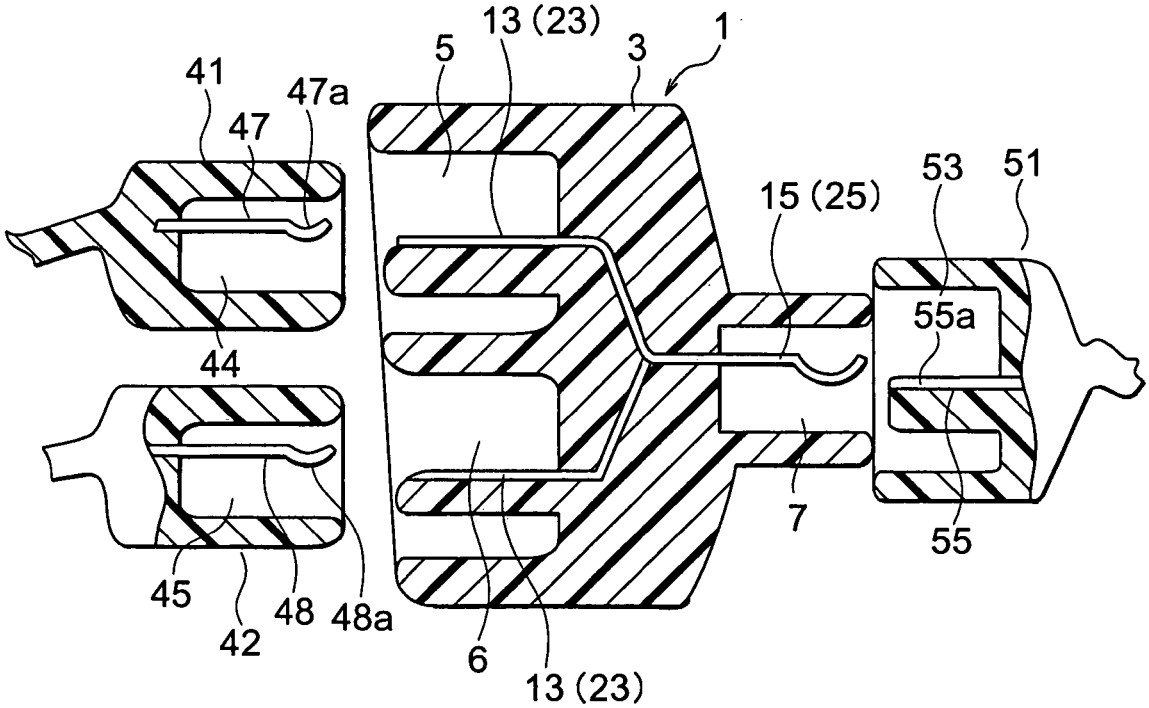
FIG. 7 is a schematic cross-sectional view illustrating the connector shown in FIG. 1 and objects subject to connection by being engaged to the connector.

FIG. 6 is a back view of the connector 1 shown in FIG. 1. FIG. 7 illustrates the connector 1, and first opponent connectors (first and second connection objects) and a second opponent connector (a third connection object) before being connected to the connector 1.

Referring to FIGS. 1, 6, and 7, a front surface of the connector 1 has a pair of first engagement portions 5, 6 engageable to a pair of first opponent connectors 41, 42 defining the first and second connection objects. The first engagement portion 5 has the first signal connection segments 13 of the upper array and the first ground connection segments 23 of the upper array shown in FIGS. 2 and 3 disposed therein. The first engagement portion 6 has the first signal connection segments 13 of the lower array and the first ground connection segments 23 of the lower array shown in FIGS. 2 and 3 disposed therein.

The first opponent connector 41 has a first-opponent engagement portion 44. The first-opponent engagement portion 44 has a plurality of first-opponent connection segments 47*a* of first opponent contacts 47 disposed therein. Likewise, the first opponent connector 42 has a first-opponent engagement portion 45. The first-opponent engagement portion 45 has a plurality of first-opponent connection segments 48*a* of first opponent contacts 48 disposed therein.

The first opponent contacts 47 include a combination of opponent signal contacts connected to a central conductor of a transmissive coaxial cable, which is not shown, and opponent ground contacts connected to an external conductor of the transmissive cable. Similarly, the first opponent contacts 48 include a combination of opponent signal contacts connected to a central conductor of a transmissive coaxial cable, which is not shown, and opponent ground contacts connected to an external conductor of the transmissive cable.

The number of first-opponent connection segments 47*a* provided is determined based on the number necessary for signal transmission and for grounding. The first-opponent connection segments 47*a* are connected correspondingly to the first signal connection segments 13 and the first ground connection segments 23 in a one-to-one fashion. Similarly, the number of first-opponent connection segments 48*a* provided is determined based on the number necessary for signal transmission and for grounding. The first-opponent connection segments 48*a* are connected correspondingly to the first signal connection segments 13 and the first ground connection segments 23 in a one-to-one fashion.

A back surface of the connector 1 has a single second engagement portion 7 engageable to a single second opponent connector 51 defining the third connection object. The second engagement portion 7 has the second signal connection segments 15 of the signal contacts 11 and the second ground connection segments 25 of the ground contacts 21 shown in FIG. 2 disposed therein.

The second opponent connector 51 has a second-opponent engagement portion 53 engageable to the second engagement portion 7. The second-opponent engagement portion 53 has second-opponent connection segments 55*a* of second opponent contacts 55 disposed therein. The second-opponent connection segments 55*a* are connectable to the second signal connection segments 15 of the signal contacts 11 and the second ground connection segments 25 of the ground contacts 21.

The second opponent contacts 55 include a combination of opponent signal contacts connected to a central conductor of a transmissive coaxial cable, which is not shown, and opponent ground contacts connected to an external conductor of the transmissive cable.

When the first-opponent engagement portion 44 of the first opponent connector 41 is engaged to the first engagement portion 5 of the connector 1 in a one-to-one fashion, the first-opponent connection segments 47*a* are connected to the corresponding first signal connection segments 13 and the corresponding first ground connection segments 23. Similarly, when the first-opponent engagement portion 45 of the first opponent connector 42 is engaged to the first engagement portion 6 of the connector 1 in a one-to-one fashion, the first-opponent connection segments 48*a* are connected to the corresponding first signal connection segments 13 and the corresponding first ground connection segments 23.

Likewise, when the second-opponent engagement portion 53 of the second opponent connector 51 is engaged to the second engagement portion 7 of the connector 1, the second-opponent connection segments 55*a* are connected correspondingly to the second signal connection segments 15 and the second ground connection segments 25.

Figure 8:
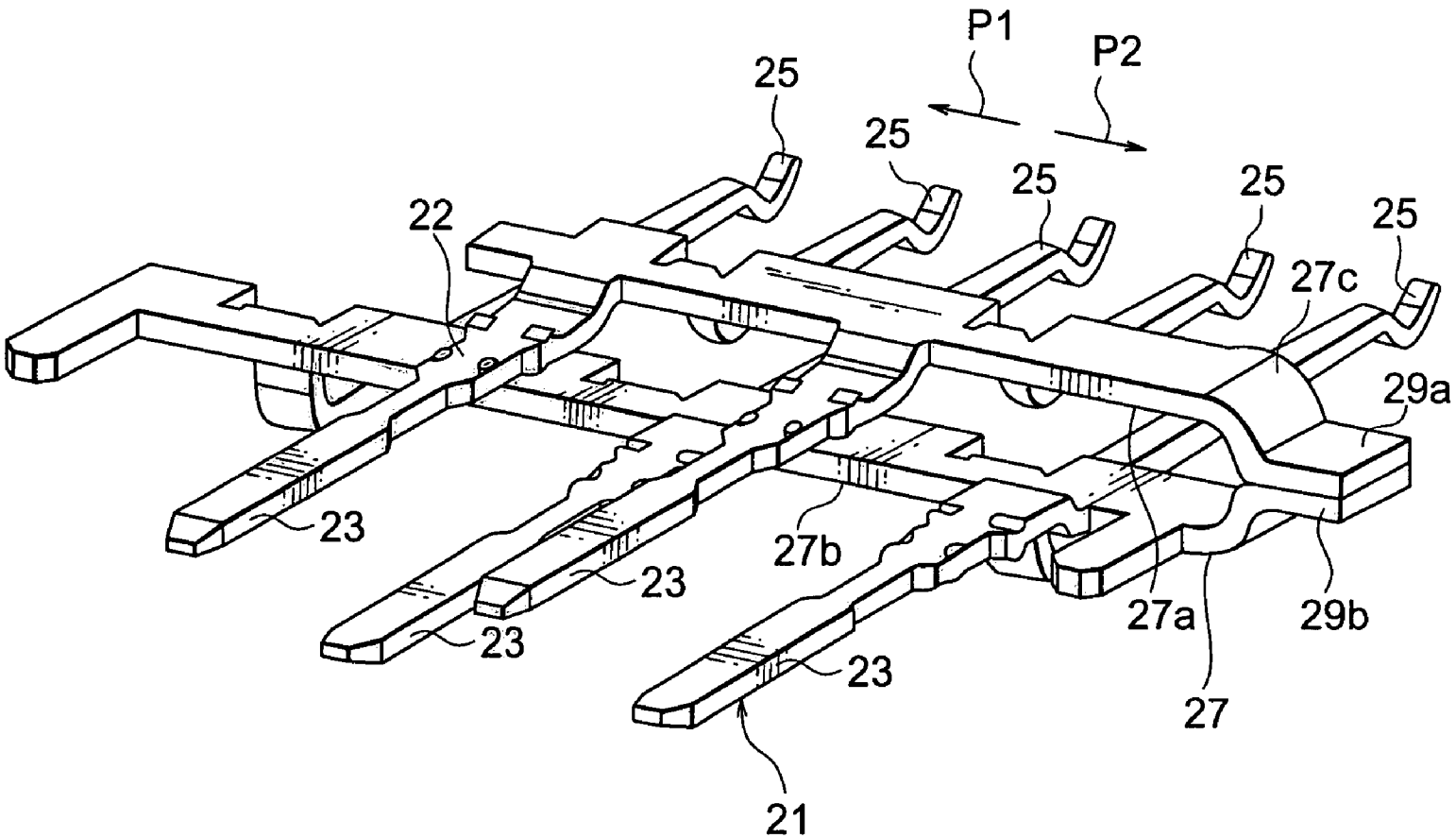
FIG. 8 is a perspective view illustrating a modification example of the ground contacts shown in FIG. 4.

FIG. 8 illustrates a modification example of the ground contacts 21. In this modification example, the differences from the ground contacts 21 shown in FIG. 4 are directed to only some parts of the intermediate segment 27. Therefore, the components in this modification example that are the same as those included in the ground contacts 21 in FIG. 4 are given the same reference numerals, and detailed descriptions of those components will be omitted below.

Referring to FIG. 8, an end portion of the intermediate segment 27 closer to the pitch direction P2 is divided into subsegments. Specifically, the end portion of the intermediate segment 27 is divided into flanged subsegments 29*a* and 29*b*. The flanged subsegments 29*a* and 29*b* protrude from the intermediate segment 27 in the pitch direction P2 and are integrally joined to each other.

Figure 9:
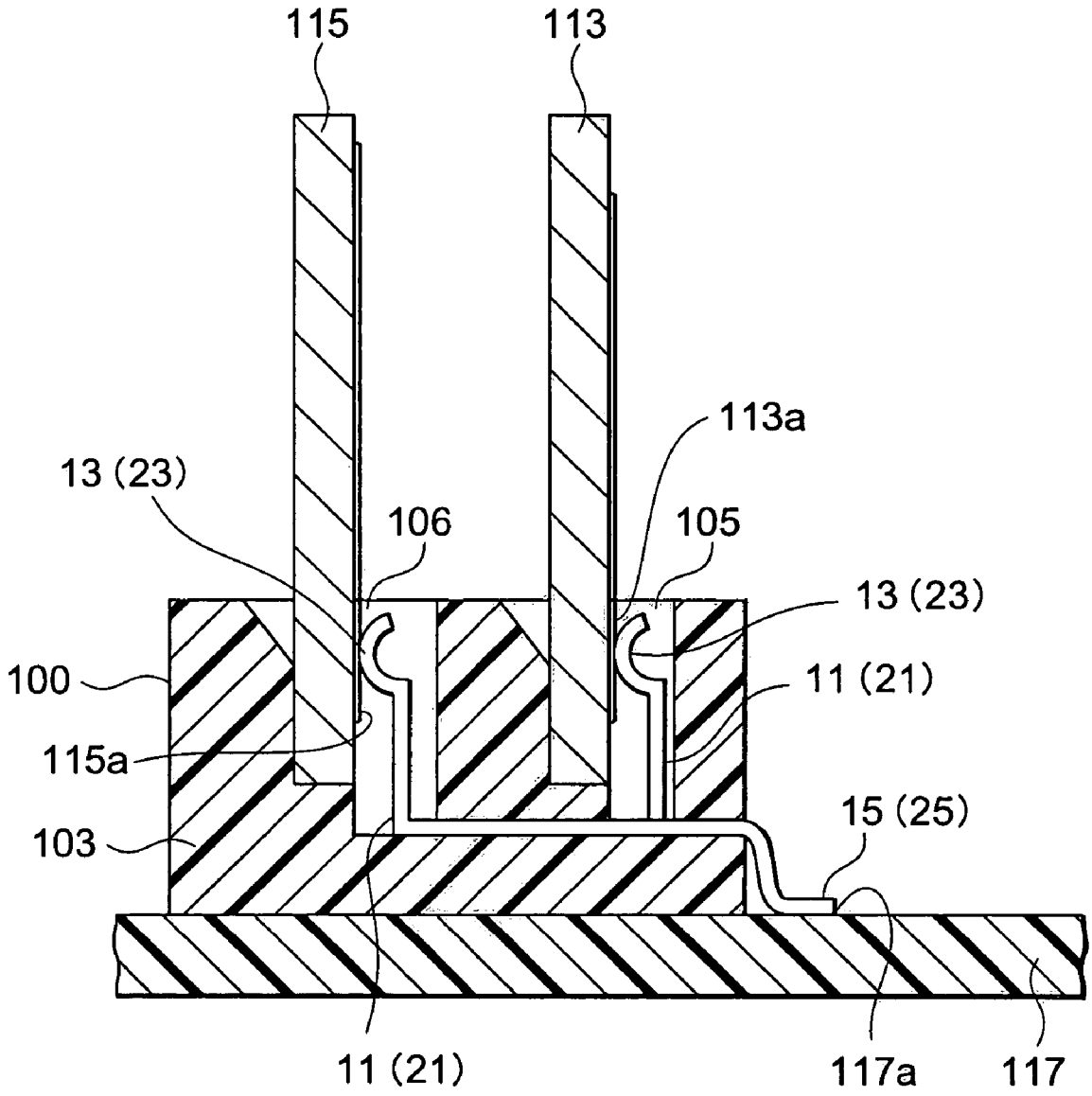
FIG. 9 is a cross-sectional view of a connector according to a second embodiment of the present invention.

FIG. 9 illustrates a connector according to a second embodiment of the present invention. A connector 100 shown in FIG. 9 connects a first sub-substrate (first connection object) 113 and a second sub-substrate (second connection object) 115 to a main substrate (main connection object) 117. The first sub-substrate 113 and the second sub-substrate 115 are alternatives to the two first opponent connectors 41, 42 illustrated in FIG. 7, respectively. Likewise, the main substrate 117 is an alternative to the second opponent connector 51 illustrated in FIG. 7.

The contacts included in the connector 100 are arranged substantially in the same manner and have substantially the same function as the signal contacts 11 and the ground contacts 21 illustrated in FIGS. 2 to 4. Therefore, the components included in the connector 100 that are the same as those shown in FIGS. 2 to 4 are given the same reference numerals.

Referring to FIGS. 2 to 4 and FIG. 9, the connector 100 includes an insulator 103, and the signal contacts 11 and the ground contacts 21 supported by the insulator 103.

The insulator 103 is mounted on the main substrate 117. One side of the insulator 103 has a first engagement portion 105 engageable to the first sub-substrate 113, and a second engagement portion 106 engageable to the second sub-substrate 115.

The first engagement portion 105 has a first array of the first signal connection segments 13 of the signal contacts 11 and the first ground connection segments 23 of the ground contacts 21 disposed therein. The first sub-substrate 113 has conductive portions 113*a*, which correspond to the first signal connection segments 13 and the first ground connection segments 23 in a one-to-one fashion in order to enable signal transmission and grounding.

The second engagement portion 106 has a second array of the first signal connection segments 13 of the signal contacts 11 and the first ground connection segments 23 of the ground contacts 21 disposed therein. The second sub-substrate 115 has conductive portions 115*a*, which correspond to the first signal connection segments 13 and the first ground connection segments 23 in a one-to-one fashion in order to enable signal transmission and grounding.

When the first engagement portion 105 is engaged to the first sub-substrate 113, the conductive portions 113*a* of the first sub-substrate 113 are connected correspondingly to the first signal connection segments 13 and the first ground connection segments 23 disposed in the first engagement portion 105 in a one-to-one fashion. Similarly, when the second engagement portion 106 is engaged to the second sub-substrate 115, the conductive portions 115*a* of the second sub-substrate 115 are connected correspondingly to the first signal connection segments 13 and the first ground connection segments 23 disposed in the second engagement portion 106 in a one-to-one fashion.

The second signal connection segments 15 of the signal contacts 11 and the second ground connection segments 25 of the ground contacts 21 extend outward from the insulator 103. The second signal connection segments 15 and the second ground connection segments 25 are soldered correspondingly to conductive portions 117*a* provided in the main substrate 117 in a one-to-one fashion so as to enable signal transmission and grounding.

The second signal connection segments 15 and the second ground connection segments 25 extend through a through-hole provided in the main substrate 117, and are connected to the corresponding conductive portions 117*a* within the through-hole.

As described above, in the connector 1 or 100, the contacts are arranged in the pitch directions P1 and P2 in the following order: a pair of signal contacts 11, one ground contact 21, a pair of signal contacts 11, one ground contact 21, and so on. For this reason, even when the two signal contacts 11 of each pair are switched with each other, the electrical relationship between the two signal contacts 11 and the ground contacts 21 can still be maintained.

Furthermore, the connector 1 or 100 can readily maintain the impedance matching, and can be improved in performance with respect to high-frequency characteristics.

While the present invention has thus far been described in connection with a few preferred embodiments thereof, it will readily be possible for those skilled in the art to put this invention into practice in various other manners.

What is claimed is:

1. An electrical connector having a first end and a second end opposite to the first end, the electrical connector comprising:

a plurality of conductive contacts, including a plurality of ground contacts and a plurality of signal contact pairs each including a pair of the conductive contacts;

a conductive connecting member electrically connected to the ground contacts; and an insulator supporting the conductive contacts, wherein at the first end of the electrical connector, the signal contact pairs and the ground contacts are arranged in a first and a second row which are parallel to each other and extend in a first direction, wherein at the second end of the electrical connector, the signal contact pairs and the ground contacts are arranged in a single row, such that each of the ground contacts in an interior of said single row is interposed between: (i) one of the signal contact pairs that is in the first row at the first end of the electrical connector, and (ii) one of the signal contact pairs that is in the second row at the first end of the electrical connector, and wherein each of the ground contacts comprises a first segment at the first end of the electrical connector, a second segment at the second end of the electrical connector, and an intermediate segment between the first and the second segments, and the conductive connecting member is formed integrally with the intermediate segments.

2. The electrical connector according to claim 1, wherein, at the first end of the electrical connector, the conductive contacts in each of the signal contact pairs are adjacent to each other along each of the first and the second rows.

3. The electrical connector according to claim 2, wherein, at the first end of the electrical connector, each of the ground contacts is interposed between adjacent ones of the signal contact pairs.

4. The electrical connector according to claim 3, wherein, at the first end of the electrical connector, the signal contact pairs in the first row and the have different positions along the first direction so that each of the ground contacts faces one of the signal contact pairs in a second direction perpendicular to the first direction.

5. The electrical connector according to claim 1, wherein the signal contact pairs that are in the first row at the first end of the electrical connector and the signal contact pairs that are in the second row at the first end of the electrical connector are alternately arranged along the single row at the second end of the electrical connector.

6. The electrical connector according to claim 1, wherein the first segment and the second segment of each of the ground contacts are have different positions along the first direction.

7. The electrical connector according to claim 1, wherein the conductive connecting member comprises a first plate extending along the first row and a second plate extending along the second row and electrically connected to the first plate, the first plate is electrically connected to the ground contacts arranged in the first row at the first end of the electrical connector , and the second plate is electrically connected to the ground contacts arranged in the second row at the first end of the electrical connector.

8. The electrical connector according to claim 7, wherein the first and the second plates are formed integrally with each other.

9. The electrical connector according to claim 7, wherein the first and the second plates have respective flange portions, which are superposed and connected to each other.

10. The electrical connector according to claim 1, wherein each of the ground contacts has contact terminals, which are placed at the first and the second ends of the electrical connector, respectively, and the contact terminals of each of the ground contacts have different positions with respect to each other along the first direction.

* * * * *

UNITED STATES PATENT AND TRADEMARK OFFICE

CERTIFICATE OF CORRECTION

PATENT NO. : 7,128,611 B2
APPLICATION NO. : 11/252357
DATED : October 31, 2006
INVENTOR(S) : Yukitaka Tanaka It is certified that error appears in the above-identified patent and that said Letters Patent is hereby corrected as shown below:

Column 10, line 1, after “and the” insert --signal contact pairs in the second row--.

Signed and Sealed this

Eleventh Day of November, 2008

JON W. DUDAS
*Director of the United States Patent and Trademark Office*